US010371149B2

(12) United States Patent
Lodefier

(10) Patent No.: US 10,371,149 B2
(45) Date of Patent: Aug. 6, 2019

(54) SCREW COMPRESSOR ELEMENT

(71) Applicant: ATLAS COPCO AIRPOWER, NAAMLOZE VENNOOTSCHAP, Wilrijk (BE)

(72) Inventor: Koen Roger L Lodefier, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 91 days.

(21) Appl. No.: 15/507,056

(22) PCT Filed: Sep. 2, 2015

(86) PCT No.: PCT/BE2015/000041

§ 371 (c)(1),
(2) Date: Feb. 27, 2017

(87) PCT Pub. No.: WO2016/037242

PCT Pub. Date: Mar. 17, 2016

(65) Prior Publication Data

US 2017/0298938 A1 Oct. 19, 2017

(30) Foreign Application Priority Data

Sep. 10, 2014 (BE) ..... 2014/0681

(51) Int. Cl.
*F01C 1/16* (2006.01)
*F03C 2/00* (2006.01)
(Continued)

(52) U.S. Cl.
CPC ..... *F04C 29/12* (2013.01); *F04C 18/16* (2013.01); *F04C 2240/30* (2013.01); *F04C 2250/101* (2013.01)

(58) Field of Classification Search
CPC .... F04C 18/16; F04C 29/12; F04C 2250/101; F04C 2240/30
(Continued)

(56) References Cited

U.S. PATENT DOCUMENTS 2,358,815 A 9/1944 Lysholm
3,437,263 A 4/1969 Persson
(Continued)

FOREIGN PATENT DOCUMENTS

DE 7611162 U1 4/1978
DE 4426761 A1 1/1996
(Continued)

OTHER PUBLICATIONS

International Search Report (ISR) dated Mar. 29, 2016, for PCT/BE2015/000041.

*Primary Examiner* — Theresa Trieu
(74) *Attorney, Agent, or Firm* — Bacon & Thomas, PLLC

(57) ABSTRACT

A screw compressor element with a housing and two screw rotors that are affixed in the housing in a double cylindrical chamber provided to this end, whereby the housing is provided with an inlet opening on the inlet side of the screw compressor element, whereby the inlet opening extends in the cylindrical walls of the double cylindrical chamber with at least a section that extends in an axial direction, and a transverse section connecting thereto in the form of a strip that extends from the axial section on the inlet side to a side of the section in a direction transverse to the axial direction.

23 Claims, 5 Drawing Sheets

(51) Int. Cl.

| | |
|---|---|
| ***F03C 4/00*** | (2006.01) |
| ***F04C 29/12*** | (2006.01) |
| ***F04C 18/16*** | (2006.01) |

(58) Field of Classification Search
USPC ..... 418/201.1–201.3, 199–200
See application file for complete search history.

(56) References Cited

U.S. PATENT DOCUMENTS

| | | | | | |
|---|---|---|---|---|---|
| 3,867,076 | A | | 2/1975 | Spindler | |
| 4,080,119 | A | | 3/1978 | Eriksson | |
| 4,488,858 | A | | 12/1984 | Glanvall | |
| 4,609,335 | A | * | 9/1986 | Uthoff, Jr. ..... | F04C 18/16 418/201.1 |
| 4,714,418 | A | * | 12/1987 | Matsubara ..... | F04C 18/16 418/201.1 |
| 4,808,095 | A | * | 2/1989 | Nishitani ..... | F04C 15/06 418/15 |
| 9,228,590 | B2 | | 1/2016 | Nachtergaele et al. | |

FOREIGN PATENT DOCUMENTS

| | | | |
|---|---|---|---|
| EP | 0166851 | A2 | 1/1986 |
| EP | 0176270 | A2 | 4/1986 |
| GB | 665565 | A | 1/1952 |
| GB | 2106594 | A | 4/1983 |
| JP | S59-176490 | A | 10/1984 |
| JP | 2000-130378 | A | 5/2000 |
| NL | 6708715 | A | 12/1967 |
| RU | 2013104374 | A | 8/2014 |

* cited by examiner

SCREW COMPRESSOR ELEMENT

The present invention relates to a screw compressor element for compressing gas.

More specifically the invention concerns a screw compressor element that comprises a housing and two helical rotors that are rotatably affixed in the housing in a double cylindrical chamber provided to this end composed of two single cylindrical rotor chambers, that merge into one another along two axial ribs, the 'cusps', and whereby the double cylindrical chamber is defined by the cylindrical walls of the rotor chambers and two end faces of the housing, respectively an end face at an inlet side and an end face at an outlet side of the screw compressor element, whereby on the inlet side of the screw compressor element the housing is provided with an inlet opening for the supply of gas to be compressed.

BACKGROUND OF THE INVENTION

The inlet opening ensures that gas can be supplied to the rotor chambers, more specifically into the spaces between the lobes of the helical rotors, whereby due to the rotation of these helical rotors the gas in these spaces can be compressed.

Two types of inlet openings are known, i.e. a radial inlet opening and an axial inlet opening.

An axial inlet opening is situated at the level of the end face on the inlet side of the housing.

Such an axial inlet opening ensures a supply of gas to the rotor chambers in the axial direction, i.e. along a direction parallel or essentially parallel to the axes of the helical rotors.

An axial inlet opening is situated very close to the vicinity of the (shaft) seals and bearings. This has the disadvantage that this typically leads to greater complexity and a requirement for longer rotor shafts.

A radial inlet opening is situated at the location of the cylindrical walls of the rotor chambers and ensures a supply of gas to the rotor chambers in the radial direction, i.e. along a direction perpendicular or essentially perpendicular to the axes of the helical rotors.

A radial inlet opening has the advantage that it is not only easy to realise, but also that the helical rotors are accessible via the opening for inspection, maintenance or synchronisation of the helical rotors.

It is known that the shape of the inlet opening must satisfy many requirements.

In order to be able to fill the spaces between the lobes of the helical rotors with gas to be compressed as optimally as possible, the inlet opening is preferably kept as large as possible, whereby it is ensured that the closure of the inlet opening happens at the right time due to the rotation of the helical rotors.

An idealised shape follows from these requirements, i.e. the 'delta shape', whereby a triangular inlet opening is defined from the shape of the lobes of the helical rotors so to speak.

This idealised shape has a few disadvantages.

Firstly such a large opening in the housing negatively affects the mechanical strength of the housing.

Secondly a connection must be made to an inlet pipe for the supply of the gas to be compressed, whereby the transition from the triangular inlet opening to the inlet pipe is technically very difficult to realise and whereby an inlet pipe with a very large diameter will be necessary.

It is clear that in practice such a 'delta shape' is rarely used for screw compressors. This idealised shape is often departed from by truncating the two base angles of the 'delta shape' such as described in NL 6.708.715, for example.

In other words the inlet opening is smaller, such that the mechanical strength of the housing is not jeopardized too much, while a good filling of the spaces between the lobes of the helical rotors is always obtained.

However, due to the rotation of the helical rotors during the operation of the screw compressor, turbulence occurs in the gas that is in the inlet opening or inlet zone, such that 'mixing losses' occur. Such losses are greater at high speeds of the helical rotors.

Due to these losses a proportion of the gas between the lobes of the helical rotors is thrown or blown away as it were. In other words: a proportion of the gas between the lobes will be lost, such that the efficiency of the screw compressor will decrease.

In order to prevent this a number of solutions are known, such as the use of ribs or partitions in the inlet opening to guide the flow of the gas to be compressed, as described in the utility model DE 7.611.162.

This has the disadvantage that a lot of flow resistance is generated without counteracting all mixing losses. Despite the guiding of the flow the spaces between the lobes cannot be filled optimally.

In DE 44.26.761 use is made of an axial inlet opening, whereby a delta-shaped recess or hollowing is made in the housing for the flow of the gas supplied so that an additional radial filling of the spaces between the lobes is obtained.

In order to prevent the turbulence or vortices in the delta-shaped recess, partitions or blades are affixed in the aforementioned recess.

Such a construction, not only with an axial inlet opening but also with the aforementioned partitions in the housing, is technically very difficult to realise.

In U.S. Pat. No. 4,488,858 use is made of a radial inlet opening in a truncated 'delta shape', such as in NL 6.708.715, whereby the truncated angles of the delta in the housing are milled or hollowed out but whereby a thin strip or edge between the truncated delta and both truncated angles is preserved.

As a result the traditional 'delta shape' of the inlet opening is created so to speak, whereby the two edges must limit the vortices.

However, these edges will prevent a good filling of the spaces between the lobes, as they ensure an at least partial or temporary closure of the hollowed parts of the housing when the helical rotors are rotating.

Moreover, mixing losses will still occur in the hollowed parts.

SUMMARY OF THE INVENTION

The purpose of the present invention is to provide a solution to at least one of the aforementioned and other disadvantages.

The object of the present invention is a screw compressor element whereby this screw compressor element comprises a housing and two helical rotors that are rotatably affixed in the housing in a double cylindrical chamber provided to this end, composed of two single cylindrical rotor chambers that merge into one another along two axial ribs and whereby the double cylindrical chamber is defined by the cylindrical walls of the rotor chambers and two end faces of the housing, respectively an end face on the inlet side and an end face on the outlet side of the screw compressor element, whereby the housing is provided on the inlet side of the screw compressor element with an inlet opening for the supply of a gas to be compressed, whereby the inlet opening at least partially extends in the cylindrical walls of the rotor chambers with at least an axial section that extends in the axial direction on either side of one of the aforementioned axial ribs, and a transverse section connected thereto in the form of a strip that extends from a base of the axial section on the inlet side of the screw compressor element at a side of the axial section in a direction essentially transverse to the direction of the axial ribs and connects to the end face on the inlet side or is at a distance therefrom.

In the following, the aforementioned two axial ribs will also be designated by the term "cusp".

An advantage is that such a shape of inlet opening can keep the mixing losses to a minimum or even eliminate them altogether, while a good filling of the spaces between the lobes of the helical rotors can nonetheless be obtained by means of the transverse section.

The width of the axial section can be kept more limited than in the known 'truncated' delta-shaped inlet opening, which will greatly reduce the mixing losses.

The reduced supply possibilities of gas to be compressed as a result of the smaller area of the axial section is offset by the transverse section, such that the flow rate or flow speed of the gas supplied remains the same or approximately the same.

The transverse section extends such that the spaces between the lobes can be filled optimally.

Another advantage is that the inlet opening is constructively easy to realise without reducing the mechanical strength of the housing.

In a preferred embodiment a transverse section extends on both sides of the axial section.

This has the advantage that both helical rotors can be filled with gas along such a transverse section, which will increase the efficiency.

Preferably the axial section of the inlet opening is formed by an opening through the housing and the transverse section connected thereto is formed by a recess in the wall.

This has the advantage that this benefits the mechanical strength of the housing as the housing is only open over a limited area and that the connection of an inlet pipe to the inlet opening is easy to realise.

According to a preferred characteristic of the invention the recess in the wall gradually becomes shallower in the direction away from the axial section.

This will cause a good flow of the gas. As more gas is carried into the space between the lobes, less gas will flow through the transverse section such that the speed of the gas can decrease. By making the recess shallower this can be counteracted and a good efficient filling will be ensured.

The invention also concerns a screw compressor that comprises at least one screw compressor element according to any one of the attached claims.

BRIEF DESCRIPTION OF THE DRAWINGS

With the intention of better showing the characteristics of the invention, a few preferred embodiments of a screw compressor element according to the invention are described hereinafter by way of an example, without any limiting nature, with reference to the accompanying drawings, wherein.

DETAILED DESCRIPTION OF THE INVENTION

Figure 1:
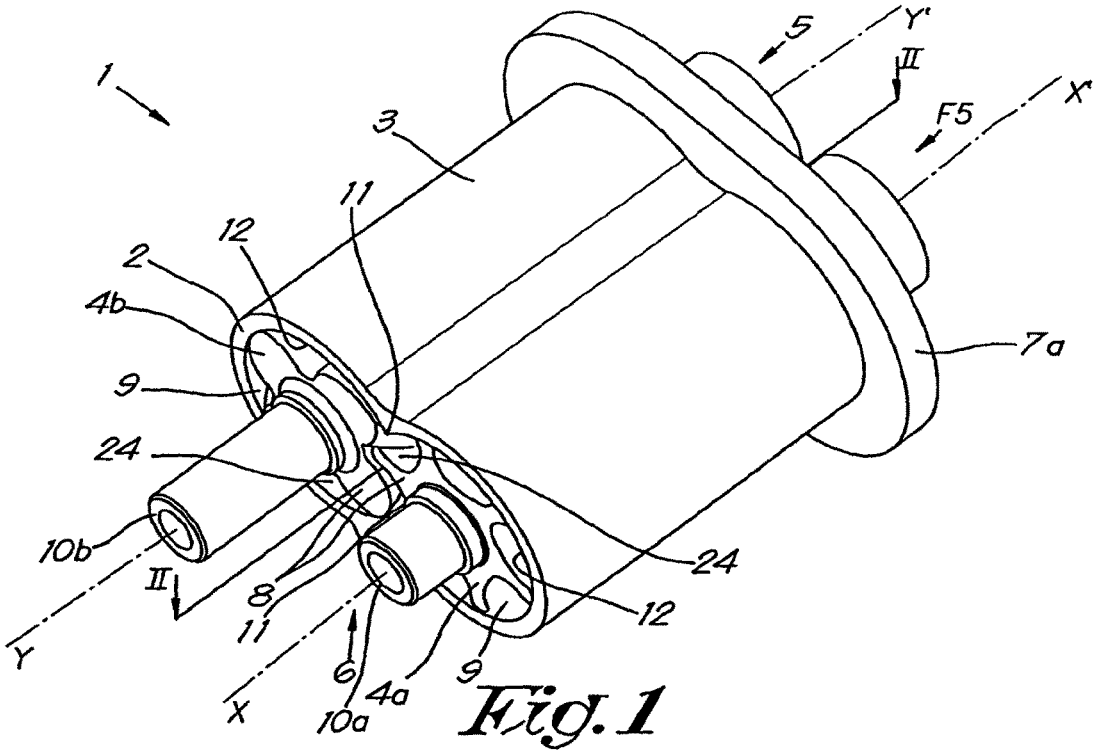
FIG. 1 schematically shows a perspective view of a housing of a screw compressor element according to the invention with two helical rotors affixed therein.

FIG. 1 schematically shows a perspective view of a screw compressor element 1 according to the invention, at least the double cylindrical chamber 2 of the housing 3 with two helical rotors 4*a* and 4*b* affixed therein, a female helical rotor 4*a* and a male helical rotor 4*b*.

The screw compressor element 1 has an inlet side 5 and an outlet side 6. The inlet end face 7*a* of the housing 3 is shown at the inlet side 5.

The other components of the screw compressor element 1, such as the outlet end face 7*b* on the outlet side 6, bearings and seals, are not shown for clarity.

In FIG. 1 it can clearly be seen that the helical rotors 4*a* and 4*b* are provided with lobes 8 that rotate enmeshed with one another and are affixed in the double cylindrical chamber 2.

This chamber 2 is composed of two single cylindrical rotor chambers 9, whereby the axes X-X' and Y-Y' respectively of the rotor chambers 9 as good as coincide with the shafts 10*a* and 10*b* respectively of the helical rotors 4*a* and 4*b*.

The rotor chambers 9 merge into one another along two axial ribs 11 or cusps. At the location of these cusps the lobes 8 of the helical rotors 4*a* and 4*b* turn in or out of one another.

The cylindrical walls 12 of the rotor chambers 9 and the end faces 7*a*, 7*b* of the housing 3 define the double cylindrical chamber 2.

Between the walls 12 of the rotor chambers 9 and the helical rotors 4*a* and 4*b* there is a very limited and extremely precise clearance.

Figure 2:
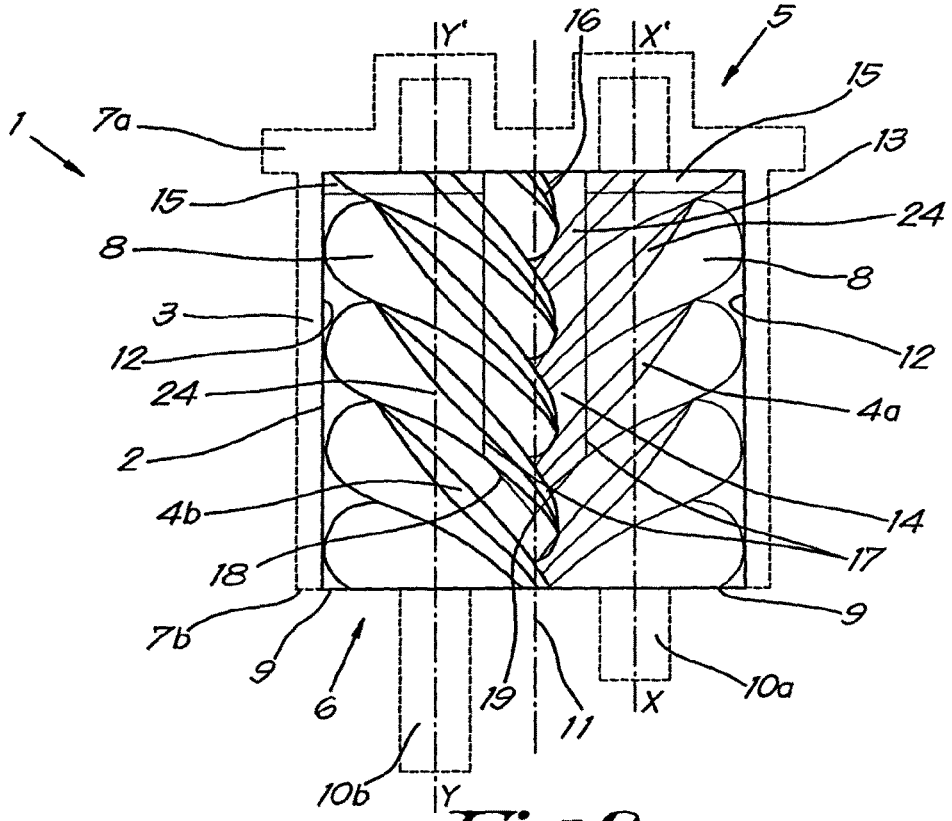
FIG. 2 shows a cross-section according to the line II-II of FIG. 1.

FIG. 2 shows a cross-section of FIG. 1 whereby the inlet opening 13 is indicated.

At the location of the inlet side 5 of the screw compressor, gas to be compressed is supplied via an inlet opening 13 in the housing 3. At the location of the outlet side 6 compressed gas is removed via an outlet opening, not shown in the drawings.

As can be seen in this drawing the inlet opening 13 comprises an axial section 14.

This axial section 14 extends in an axial direction on either side of one of the cusps. This means that the axial section 14 extends over the cylindrical walls 12 of both rotor chambers 9.

The inlet opening 13 also comprises a transverse section 15 connecting to the axial section 14. In this case there are two such transverse sections 15.

The transverse sections 15 are in the form of two strips that extend from the base 16 of the axial section 14 at the inlet side 5 on a side 17 of the axial section 14 of the inlet opening 13.

In this case the strips connect to the inlet end face 7*a* on the inlet side 5.

Figure 3:
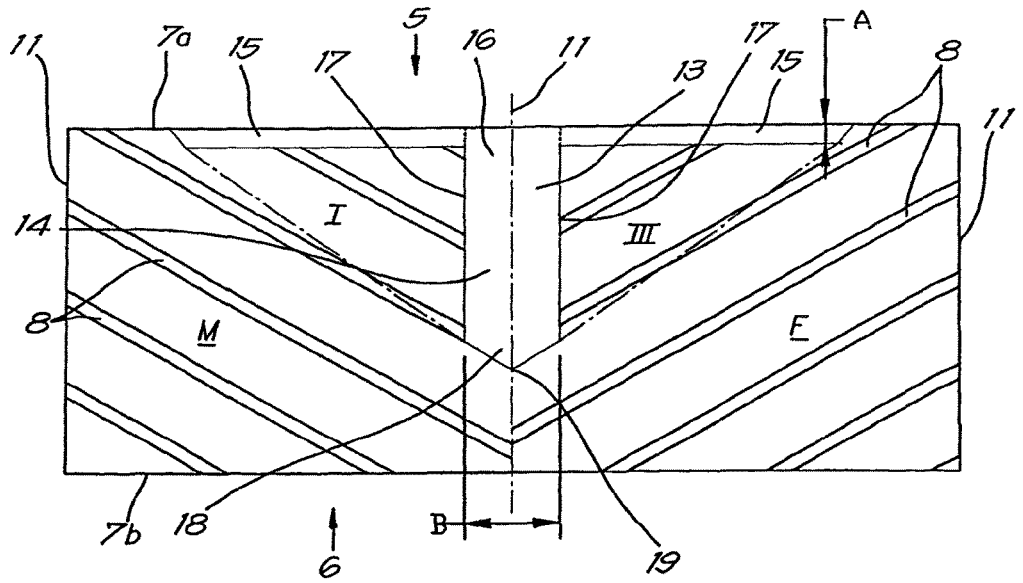
FIG. 3 shows a herringbone or unfolded diagram of the screw compressor element of FIG. 1.

FIG. 3 shows an unfolded diagram or herringbone diagram.

Such a diagram is obtained by unfolding the surface of the cylindrical walls 12 of the double cylindrical chamber 2 whereby the cylindrical walls 12 are opened up along a cut that runs along one of the aforementioned cusps.

On this plane the lobes 8 of the helical rotors 4*a*, 4*b* and the inlet opening 13 are indicated by marking.

This FIG. 3 clearly shows that the strips extend in a direction transverse to the direction of the cusp, whereby the strips extend along the largest part of the periphery of the helical rotors 4*a* and 4*b*.

It is also possible that the strips somewhat depart from the direction transverse to the axial ribs 11 or cusps.

In this example the strips have an essentially rectangular form with an essentially constant width A. It is of course not excluded that the width A can be variable. Moreover it is also possible that both strips have a different width A.

In this example, the axial section 14 of the inlet opening also has an essentially rectangular form with an essentially constant width B and in this case at the end 18 it is oriented away from the aforementioned base 16 provided with a pointed end 19.

It can also be seen in FIG. 3 that the inlet opening 13 in the plane of the unfolded cylindrical walls 12 essentially has a T-shape in this case.

More generally, preferably the area of the axial section 14 of the inlet opening 13 on any side of the cusp is approximately equal to the area of a transverse strip, or departs from it by a maximum of 50%.

The area of the axial section 14 of the inlet opening 13 is preferably approximately equal to the area of the two transverse strips together, or departs from it by a maximum of 50%.

According to the invention it is not necessary for the axial section 14 to be centred with respect to a cusp, but this axial section 14 can also be displaced with respect to this cusp.

Figure 4:
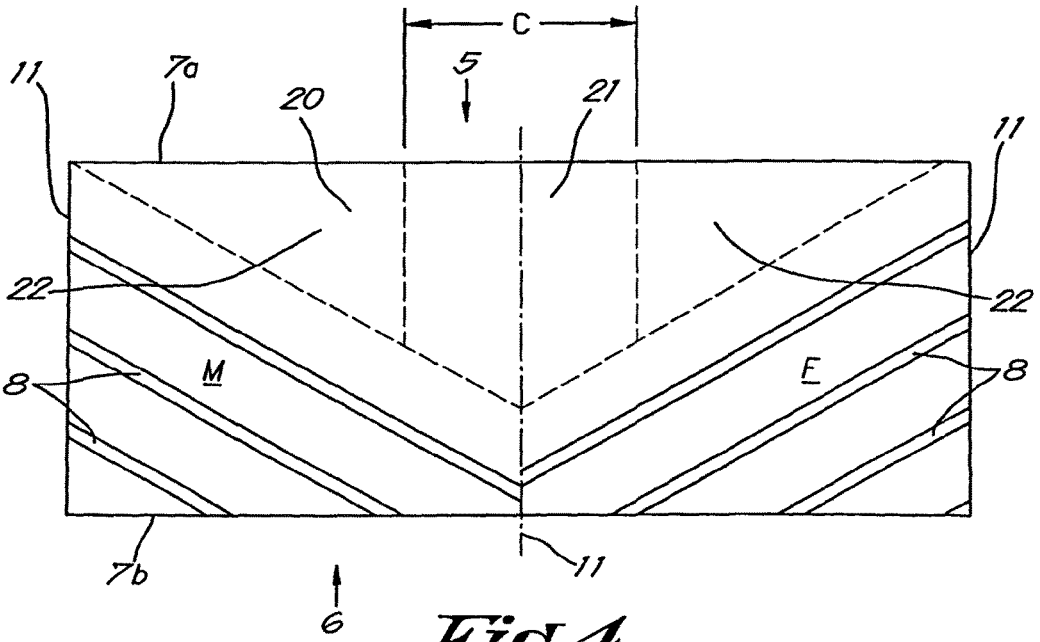
FIG. 4 shows an unfolded diagram of a housing in which a conventional inlet opening is made.

By way of an example, FIG. 4 shows an unfolded diagram of an inlet opening with an ideal 'delta shape' 20, whereby the conventionally applied truncated 'delta shape' 21 is also indicated.

This drawing clearly shows that the 'delta shape' 20 is defined on the lobes 8 of the helical rotors 4*a* and 4*b*.

Due to the truncation of the two corners 22 close to an inlet end face 7*a* of the helical rotors 4*a*, 4*b*, the conventionally applied inlet opening 21 is obtained.

From a comparison of FIGS. 3 and 4 it is clear that the width B of the axial section 14, i.e. the dimension of the axial section 14 in a direction perpendicular to the cusp, is smaller than the width C of the traditionally truncated 'delta shape' 21.

Half of the sum of the area of the axial section 14 on the side M of the male helical rotor 4*b* of the cusp and the area of the strip on the side M of the male helical rotor 4*b* of the cusp is preferably less than the area of the section I indicated in FIG. 3.

Analogously half of the sum of the area of the axial section 14 on the side F of the female helical rotor 4*a* of the cusp and the area of the strip on the side F of the female helical rotor 4*a* of the cusp is preferably less than the section III indicated in FIG. 3.

Note that the sections I and III indeed form part of a traditional inlet opening with 'delta shape' 20, but do not form part of an inlet opening 13 according to the invention. The sections I and III as it were form the difference between the two inlet openings 13 and 20.

Figure 5:
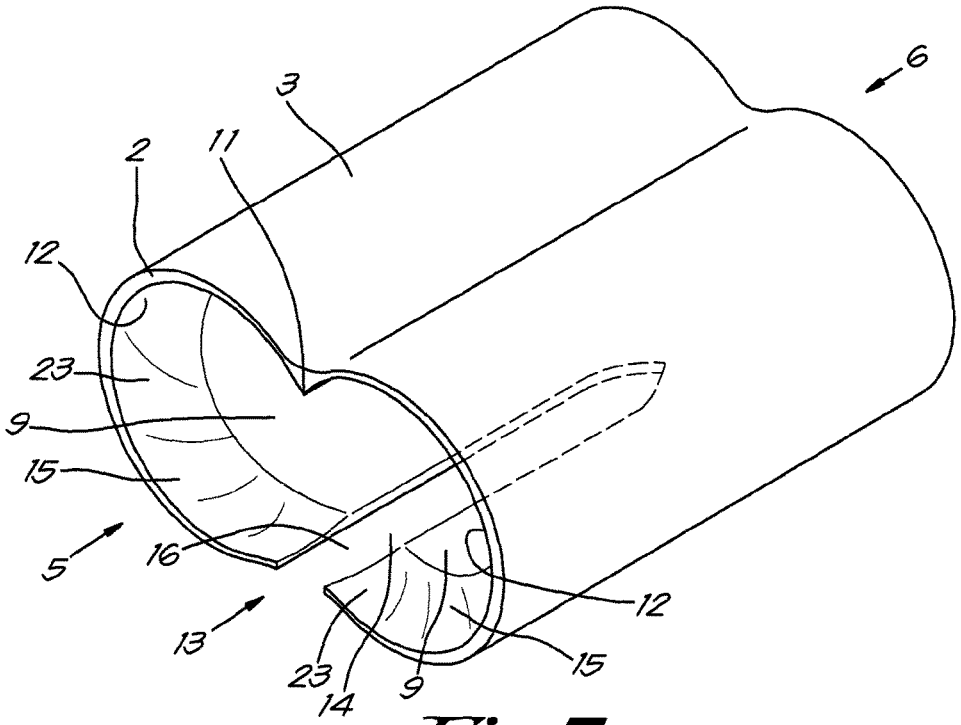
FIG. 5 shows a view according to the arrow F5 in FIG. 1, but without helical rotors.

FIG. 5 shows the inlet opening 13 in the housing 3 in more detail.

In this case the axial section 14 is constructed as an opening through the housing 3.

In this case the transverse section 15 is formed as a recess 23 in the wall 12, in other words: the housing 3 is not open at the location of the strips.

Preferably, but not necessarily, the recess 23 in the wall 12 gradually becomes shallower in the direction away from the axial section 14.

In other words the strips are formed as open channels 23 in the housing 3 that become increasingly smaller in the direction oriented towards the respective axes X-X' and Y-Y' of the rotor chambers 9.

It is also possible that the transverse section 15 is formed by an opening through the housing 3, whereby a type of curved semicylindrical covering is possibly affixed over the opening connecting to the housing 3 to form a channel that is affixed on the housing 3 as it were. This covering can be made increasingly smaller in the direction away from the axial section 14, in width and/or in depth so that a type of spiral casing is obtained that extends on both sides of the axial section 14.

It is also possible to construct the axial section 14 as a recess in the housing 3, hereby the transverse section 15 can be formed by an opening through the housing 3 and/or an axial inlet opening can be provided. The recess in the housing to form the axial section 14 can hereby gradually become shallower in the direction away from the transverse section 15.

The operation of the screw compressor 1 is very simple and as follows.

During operation the helical rotors 4*a* and 4*b* will rotate, whereby the lobes 8 will rotate enmeshed in one another.

Gas to be compressed is supplied, via the inlet opening 13, to the double cylindrical chamber 2 through which the spaces 24 between the lobes 8 can be filled with gas.

Gas will be supplied via the axial section 14 of the inlet opening 13 that will also flow via the strips along the periphery of the helical rotors 4*a* and 4*b* to fill the aforementioned spaces 24 as optimally as possible.

Due to the T-shape of the inlet opening 13 mixing losses are prevented or as good as prevented, so that no loss occurs when filling the supplied gas in the spaces 24.

Moreover, due to the form of the recess 23 that becomes increasingly shallower, the flow speed of the gas in this channel will not decrease, or not significantly so.

As a result it is ensured that at the end of the strip the optimum possible filling of the spaces 24 between the lobes 8 can be obtained, whereby no or as good as no loss will occur as there are no mixing losses due to turbulence.

Due to the rotation of the helical rotors 4*a* and 4*b* the spaces 24 will become increasingly smaller such that the gas in these spaces 24 is compressed and will leave the screw compressor element 1 via the outlet opening.

The compressed gas can then be transported to a high pressure gas network or consumers for example.

It is clear that the form of the inlet opening 13 can be constructed in many different variants without departing from the scope of the invention. By way of non-limiting examples a few possible variants are shown in FIGS. 6 to 10.

Figure 6:
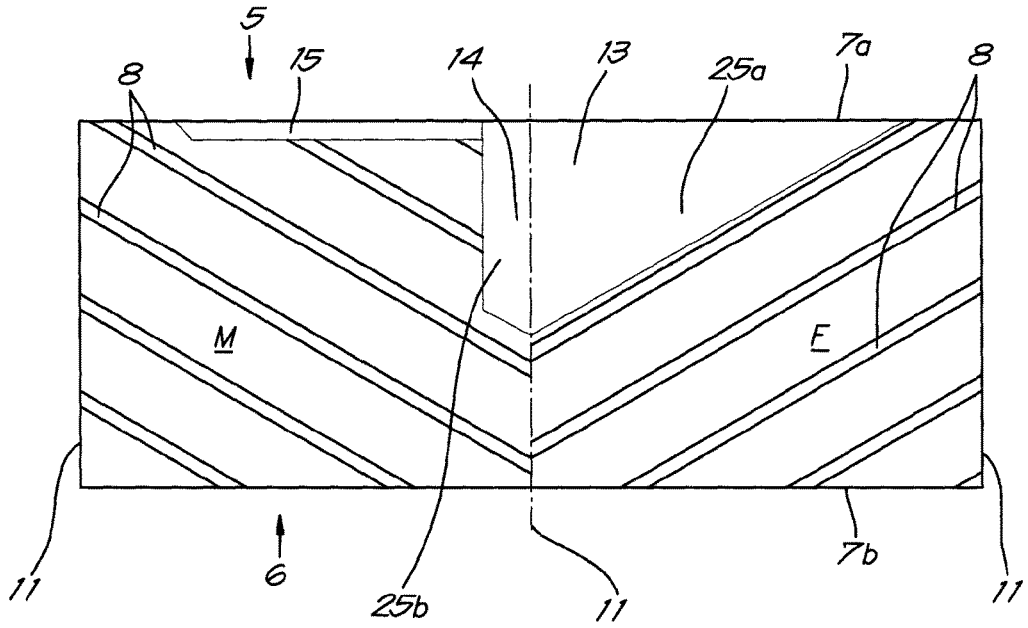
FIGS. 6 to 10 show variants of FIG. 3.

In FIG. 6 the inlet opening 13 is constructed from an axial section 14 and one strip-shaped transverse section 15.

The axial section comprises two parts 25*a* and 25*b*: a part 25*a* on one side of the cusp that encloses the female helical rotor 4*a* and a part 25*b* on the other side of the cusp that encloses the male helical rotor 4*b*. The transverse section 15 only encloses the male helical rotor 4*b*.

The part 25*a* corresponds to the part on the side F of the female helical rotor 4*a* of the cusp of the 'delta shape' 20 of FIG. 4; the part 25*b* and the transverse section 15 correspond to the part on the side M of the male helical rotor 4*b* of the cusp of the inlet opening 13 in FIG. 3.

It is known that the speed of the male helical rotor 4*b* is often higher than the speed of female helical rotor 4*a*, so that the female helical rotor 4*a* will cause less or no turbulence.

For the female helical rotor 4*a* the ideal 'delta shape' 20 can be used to maximise the filling of the lobes 8, while for the male helical rotor 4*b* the adapted shape shown in FIG. 6 can be applied to minimise turbulence.

Figure 7:
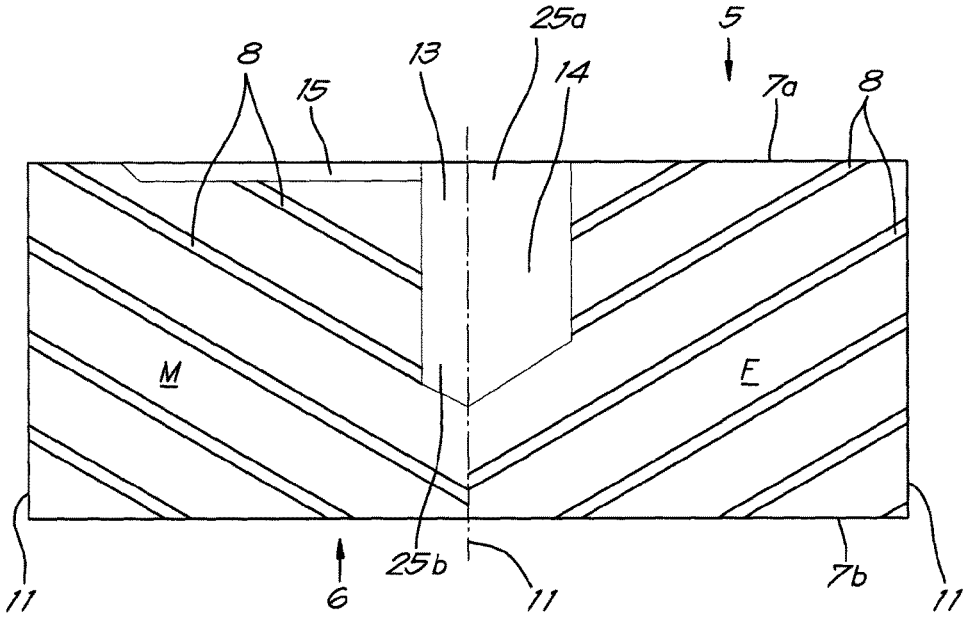

FIG. 7 shows a variant of FIG. 6, whereby in this case the part 25*a* corresponds to that part of the 'truncated' delta shape 21 of FIG. 4 that is located on the side F of the female helical rotor 4*a* of the cusp.

The inlet opening 13 has an L-shape in the plane of the walls 12 of the rotor chambers 9.

If the inlet opening 13, as shown in FIG. 6, generates too much turbulence at the location of the female helical rotor 4*a*, the inlet opening 13 can be replaced by the variant of FIG. 7. Due to the smaller part 25*a* the turbulence will be greatly reduced resulting in reduced mixing losses.

Figure 8:
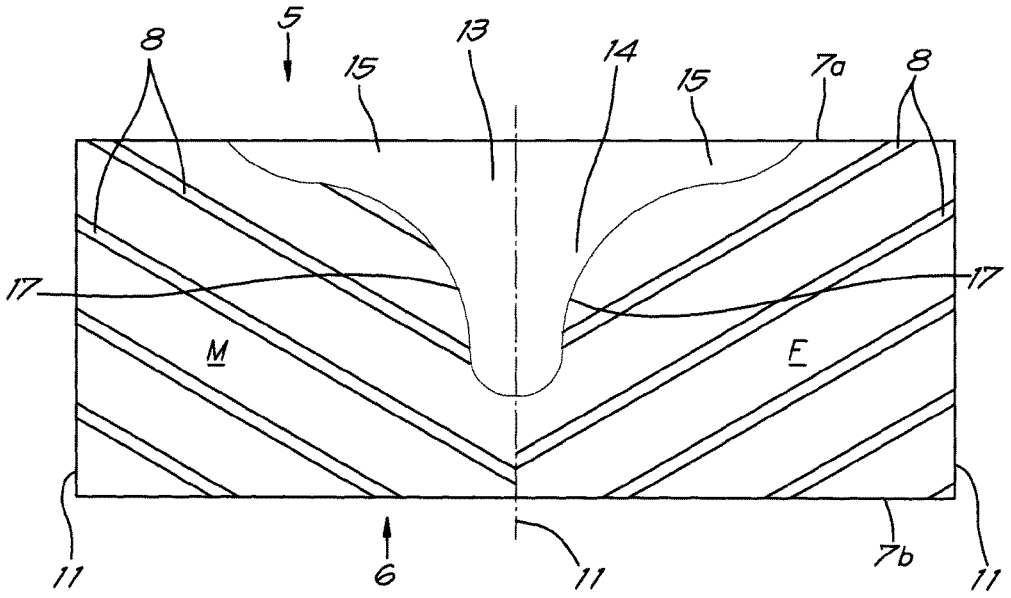

FIG. 8 shows another variant of FIG. 3, whereby the sides 17 extending in the axial direction of the axial section 14 of the inlet opening 13 are rounded to form a smooth transition to the transverse section 15.

Such a form of the inlet opening 13 will greatly reduce the turbulence due to the motion of the helical rotors 4*a* and 4*b* compared to the conventionally applied inlet openings 20, 21.

According to a variant of FIG. 8 not shown, the inlet opening 13 can be constructed such that half of the sum of the areas of the axial section 14 on one side of one of the aforementioned ribs 11 and of the transverse strip 15 is smaller than the area of a traditional inlet opening with a 'delta' shape on the side concerned of the aforementioned ribs 11, less the area of the inlet opening 13 on the side concerned of the aforementioned ribs 11.

Figure 9:
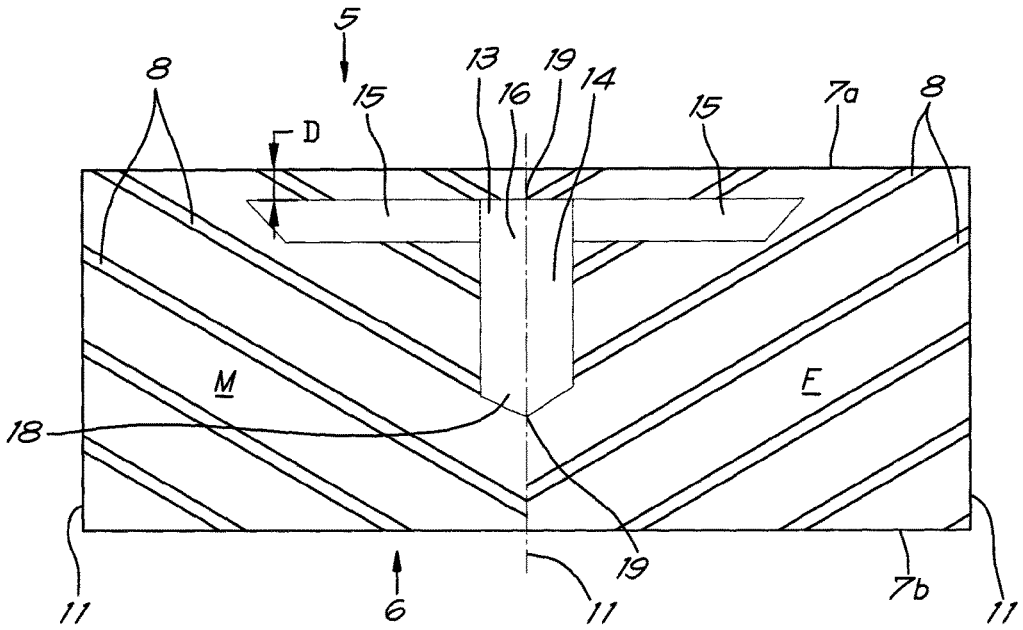

FIG. 9 shows a variant whereby the transverse sections 15 are at a distance D from the inlet end face 7*a* on the inlet side 5. This distance is preferably a small distance D.

In other words: the strips and the recesses 23 do not connect to the inlet end face 7*a*.

This has the advantage that the inlet opening 13 can be moved over a distance as it were, in a direction away from the inlet end face 7*a* at the inlet side 5 if this is necessary to be able to satisfy certain conditions of the design of the housing 3.

Figure 10:
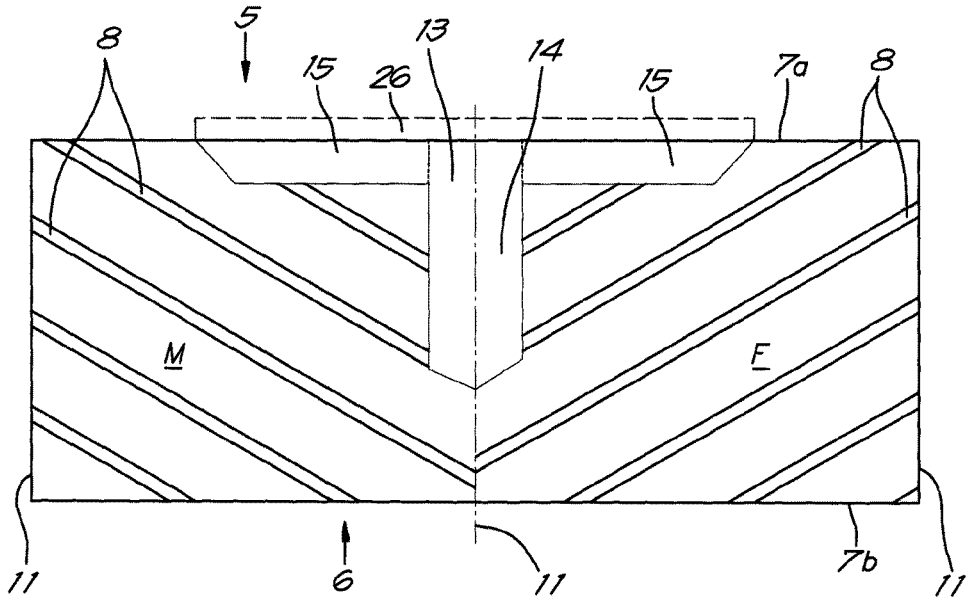

FIG. 10 shows another variant, whereby in this case the transverse section 15 connects to the inlet end face 7*a* of the inlet side 5 and moreover extends by an extra part 26 along the inlet end face 7*a* at the inlet side 5.

In other words, in this inlet end face 7*a* too, the housing 3 presents a recess.

This will ensure that the inlet opening 13, in addition to a radial section, also has a section along which gas can come into the space 24 between the lobes in the axial direction.

It is also possible that, in a variant not shown in the drawings, the arms of the T-shaped or L-shaped inlet opening 13 are connected together by a recess in the wall 12 with a limited depth. This depth is preferably a maximum of 5% of the dimension of the diameter of the helical rotors 4*a*, 4*b*. Even better this depth is a maximum of 2% of the dimensions of the diameter of the helical rotors 4*a*, 4*b*.

Preferably the form of the recess is such that the inlet opening in the plane of the walls 12 of the rotor chambers is 'delta shaped'. In other words the recess is essentially triangular.

Furthermore it is also possible that, instead of the recess in the wall 12 to form the transverse section 15 gradually becoming shallower, the width A of the strip gradually decreases, whereby the recess 23 either or not gradually becomes shallower.

It is also possible that an inlet opening 13 according to the invention is also applied in a 'single screw' screw compressor element with only one helical rotor, typically in combination with at least one toothed disk, a 'gate rotor'.

Hereby the axial section 14 of the inlet opening 13 will extend in an axial direction, i.e. a direction parallel to the axis of the helical rotor.

The transverse section 15 that connects to the axial section 14, will extend transversely to the direction of the axis of the helical rotor.

Thus such an inlet opening 13 in such a 'single screw' screw compressor element preferably has an essentially L-shape.

With such a 'single screw' screw compressor element, such an inlet opening 13 will have the aforementioned advantages, e.g. a good filling of the spaces 24 between the lobes 8 and the prevention of vortices.

Although in all of the embodiments of a screw compressor element 1 shown in the drawings, the form of the inlet opening 13 is generally made symmetrical with respect to a cusp, it is not excluded that this inlet opening 13 can also be made asymmetrical with respect to a cusp, for example depending on the ratio between the diameters of the helical rotors 4*a* and 4*b*, the number of lobes 8 of the helical rotors 4*a* and 4*b*, and the profile form of these helical rotors 4*a* and 4*b*.

The number of lobes of the helical rotors 4*a* and 4*b* can indeed vary and is not limited to the combination of male helical rotor 4*b* with four lobes 8 and female helical rotor 4*a* with six lobes 8 shown in the drawings.

The present invention is by no means limited to the embodiments described as an example and shown in the drawings, but a screw compressor element according to the invention can be realised in all kinds of forms and dimensions without departing from the scope of the invention.

The invention claimed is:

1. A screw compressor element for compressing gas, wherein this screw compressor element comprises:

a housing and two helical rotors that are rotatably affixed in the housing in a double cylindrical chamber provided to this end, composed of two single cylindrical rotor chambers that merge into one another along two axial ribs, and wherein the double cylindrical chamber is defined by cylindrical walls of the rotor chambers and two end faces of the housing, respectively, an inlet end face on an inlet side and an outlet end face on an outlet side of the screw compressor element, wherein the housing is provided on the inlet side of the screw compressor element with an inlet opening for a supply of a gas to be compressed, wherein the inlet opening at least partially extends in the cylindrical walls of the rotor chambers with at least an axial section that extends in an axial direction on either side of one of the aforementioned axial ribs in a way such that the supply of gas flows in the axial direction from the inlet side, and a transverse section connected thereto in the form of a strip that extends perpendicularly from a base of the axial section on the inlet side of the screw compressor element away from a side of the axial section in a direction transverse to the direction of the axial ribs and connects to the inlet end face on the inlet side or is at a distance therefrom.

2. The screw compressor element according to claim 1, wherein the inlet opening in the plane of the walls of the rotor chambers has an essentially T-shape or L-shape.

3. The screw compressor element according to claim 2, wherein arms of the T-shaped or L-shaped inlet opening are connected together by an essentially triangular recess in the wall.

4. The screw compressor element according to claim 3, wherein the recess has a maximum depth of 5% of the dimensions of a diameter of the screw rotors, even better a maximum of 2% of the dimensions of the diameter of the screw rotors.

5. The screw compressor element according to claim 1, wherein the transverse section extends on both sides of the axial section.

6. The screw compressor element according to claim 1, wherein the transverse section has an essentially rectangular shape, with an essentially constant width.

7. The screw compressor element according to claim 1, wherein the axial section of the inlet opening has an essentially rectangular shape, with an essentially constant width.

8. The screw compressor element according to claim 1, wherein the axial section is formed by an opening through the housing.

9. The screw compressor element according to claim 1, wherein the transverse section connecting to the axial section is formed by a recess in the cylindrical walls.

10. The screw compressor element according to claim 9, wherein the recess in the wall gradually becomes shallower in the direction away from the axial section.

11. The screw compressor element according to claim 1, wherein the axial section is formed by a recess in the cylindrical walls.

12. The screw compressor element according to claim 11, wherein the recess in the wall gradually becomes shallower in the direction away from the transverse section.

13. The screw compressor element according to claim 1, wherein the transverse section connecting to the axial section is formed by an opening through the housing.

14. The screw compressor element according to claim 13, wherein a curved semicylindrical covering is affixed over the opening of the transverse section, and connecting to the housing, to form a channel.

15. The screw compressor according to claim 14, wherein the covering gradually becomes shallower or less wide or a combination thereof in the direction away from the axial section.

16. The screw compressor element according to claim 1, wherein an area of the axial section on either side of one of the aforementioned ribs is approximately equal to an area of a transverse strip or deviates therefrom by a maximum of 50%.

17. The screw compressor element according to claim 1, wherein sides of the axial section of the inlet opening extending in the axial direction are rounded to form a smooth transition to the transverse section.

18. The screw compressor element according to claim 1, wherein the transverse section connects to the inlet end face of the inlet side and extends with at least a part along the inlet end face of the inlet side.

19. The screw compressor element according to claim 1, wherein it is an oil-free screw compressor element.

20. The screw compressor, wherein the screw compressor at least comprises one screw compressor element according to claim 1.

21. A screw compressor element for compressing gas, wherein this screw compressor element comprises:

a housing and two helical rotors that are rotatably affixed in the housing in a double cylindrical chamber provided to this end, composed of two single cylindrical rotor chambers that merge into one another along two axial ribs, and wherein the double cylindrical chamber is defined by cylindrical walls of the rotor chambers and two end faces of the housing, respectively, an inlet end face on an inlet side and an outlet end face on an outlet side of the screw compressor element, wherein the housing is provided on the inlet side of the screw compressor element with an inlet opening for a supply of a gas to be compressed, wherein the inlet opening at least partially extends in the cylindrical walls of the rotor chambers with at least an axial section that extends in an axial direction on either side of one of the aforementioned axial ribs, and a transverse section connected thereto in the form of a strip that extends from a base of the axial section on the inlet side of the screw compressor element at a side of the axial section in a direction essentially transverse to the direction of the axial ribs and connects to the inlet end face on the inlet side or is at a distance therefrom, wherein half of the sum of the areas of the axial section on one side of one of the aforementioned ribs, on the one hand, and of a transverse strip on this same side, on the other hand, is less than the area of a traditional inlet opening with a 'delta' shape on the side concerned of the aforementioned ribs, less the area of the inlet opening on the side concerned of the aforementioned ribs.

22. A screw compressor element for compressing gas, whereby this screw compressor element comprises:

a housing and a helical rotor that is rotatably affixed in a cylindrical chamber in the housing, wherein the cylindrical chamber is defined by a cylindrical wall and two end faces of the housing, respectively, an inlet end face on an inlet side and an outlet end face on an outlet side of the screw compressor element, wherein the housing on the inlet side of the screw compressor element is provided with an inlet opening for a supply of gas to be compressed, wherein the inlet opening at least partially extends in the cylindrical wall of the rotor chambers with at least an axial section that extends in an axial direction in a way such that the supply of gas flows in the axial direction from the inlet side and a transverse section connecting thereto in the form of a strip that extends perpendicularly from a base of the axial section on the inlet side of the screw compressor element away from a side of the axial section in a direction transverse to the axial direction and connects to the inlet end face on the inlet side or is at a distance therefrom.

23. The screw compressor element according to claim 22, wherein the aforementioned inlet opening presents an L-shape.

* * * * *